United States Patent [19]

Ryder

[11] Patent Number: 4,823,944

[45] Date of Patent: Apr. 25, 1989

[54] LENS CASE

[75] Inventor: Francis E. Ryder, Arab, Ala.

[73] Assignee: Ryder International Corporation, Arab, Ala.

[21] Appl. No.: 918,097

[22] Filed: Oct. 10, 1986

[51] Int. Cl.[4] ..... A45C 11/04

[52] U.S. Cl. ..... 206/5.1; 206/6; 134/137

[58] Field of Search ..... 206/5.1, 6, 560, 564; 134/137

[56] References Cited

U.S. PATENT DOCUMENTS

| | | | |
|---|---|---|---|
| 2,371,557 | 3/1945 | Sullivan | 206/6 |
| 2,642,987 | 6/1953 | Castelli | 206/6 |
| 2,877,779 | 3/1959 | Bromberg | 206/5.1 X |
| 3,124,240 | 3/1964 | Croan | 206/5.1 X |
| 3,536,082 | 10/1970 | Kolbeck | 134/137 |
| 3,856,571 | 12/1974 | Sherman | 206/5.1 X |
| 4,228,136 | 10/1980 | Thomas | 206/5.1 X |
| 4,337,858 | 7/1982 | Thomas et al. | 206/5.1 |
| 4,406,362 | 9/1983 | Thomas et al. | 206/5.1 |
| 4,501,363 | 2/1985 | Isbey, Jr. | 206/564 X |
| 4,512,468 | 4/1985 | Stravitz | 206/564 X |

FOREIGN PATENT DOCUMENTS

| | | | |
|---|---|---|---|
| 4736784 | 11/1969 | Japan | 206/5.1 |
| 2154211 | 9/1985 | United Kingdom | 206/5.1 |

OTHER PUBLICATIONS

Lenspak III-Cover Case and Universal-Contact Lens Case (date unknown).

*Primary Examiner*—David T. Fidei

*Attorney, Agent, or Firm*—Trexler, Bushnell, Giangiorgi & Blackstone, Ltd.

[57] ABSTRACT

A carrying case for a contact lens case having a predetermined peripheral configuration comprises a base member defining a predetermined peripheral configuration, a cover member defining a predetermined peripheral configuration similar to that of the base member, and a hinge joining the cover member to the base member generally along respective facing edges thereof or as to define an open condition and a closed condition of the carrying case, these similarly configured peripheries being substantially abutting and aligned in the closed condition. An insert member is mounted to the base member and comprises a frame-like member defining a recess in the base member of complementary configuration for receiving the contact lens case therewithin. A latch on the insert member engages the contact lens case for releasably holding the same received in the recess.

16 Claims, 2 Drawing Sheets

FIG. 1
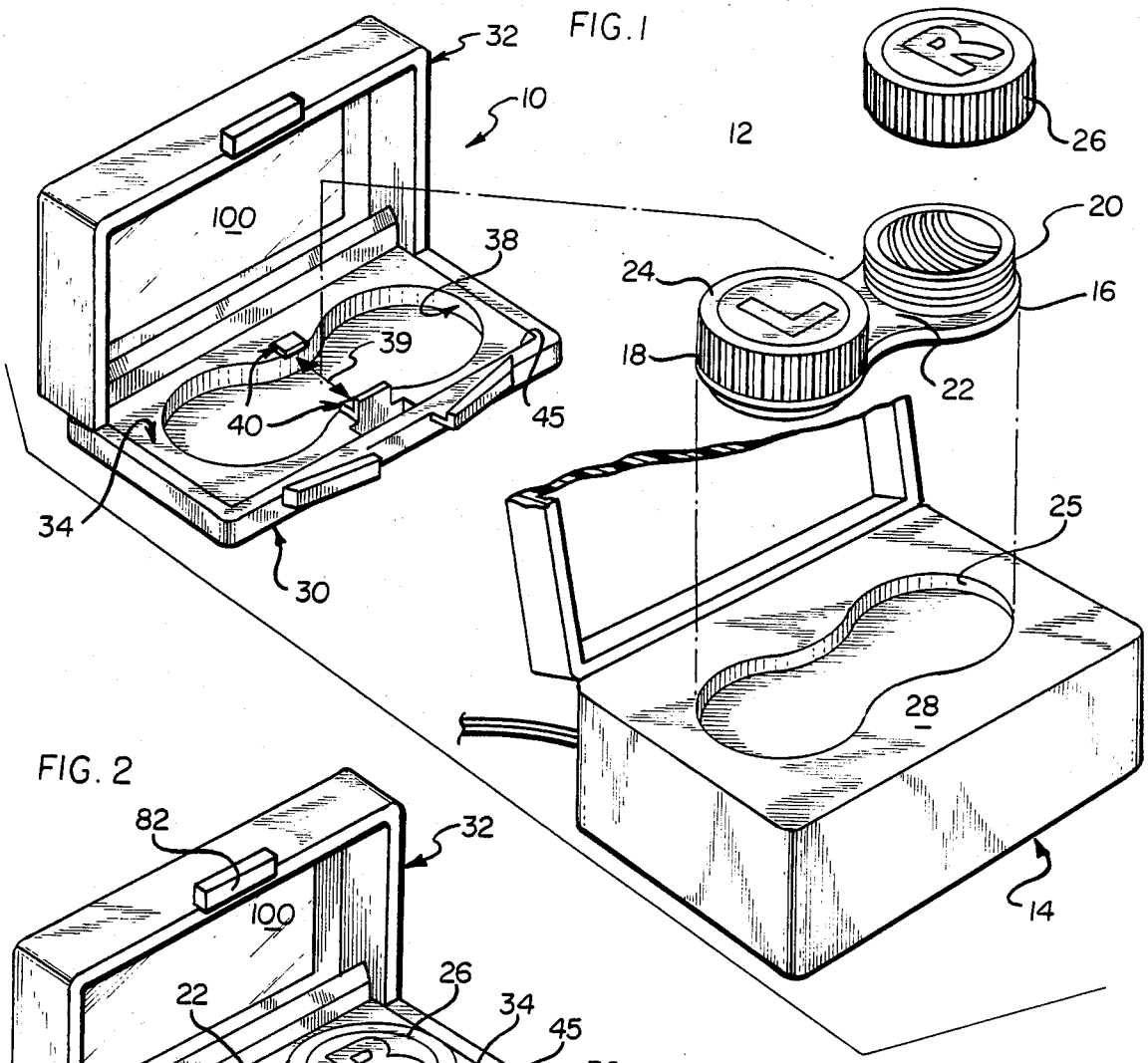
FIG. 2
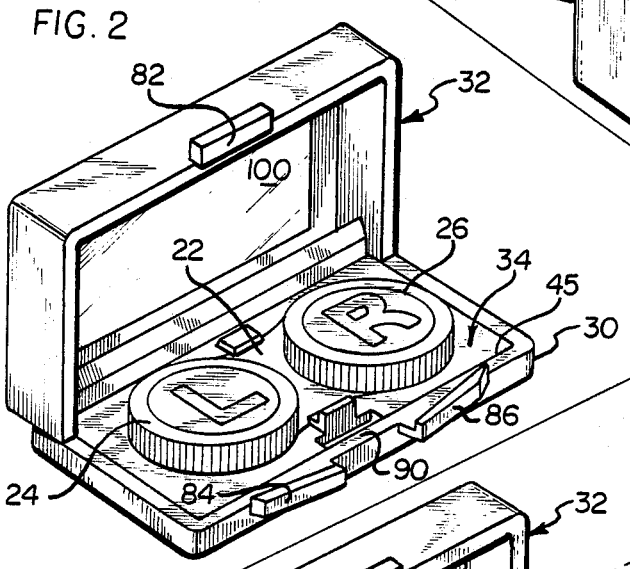
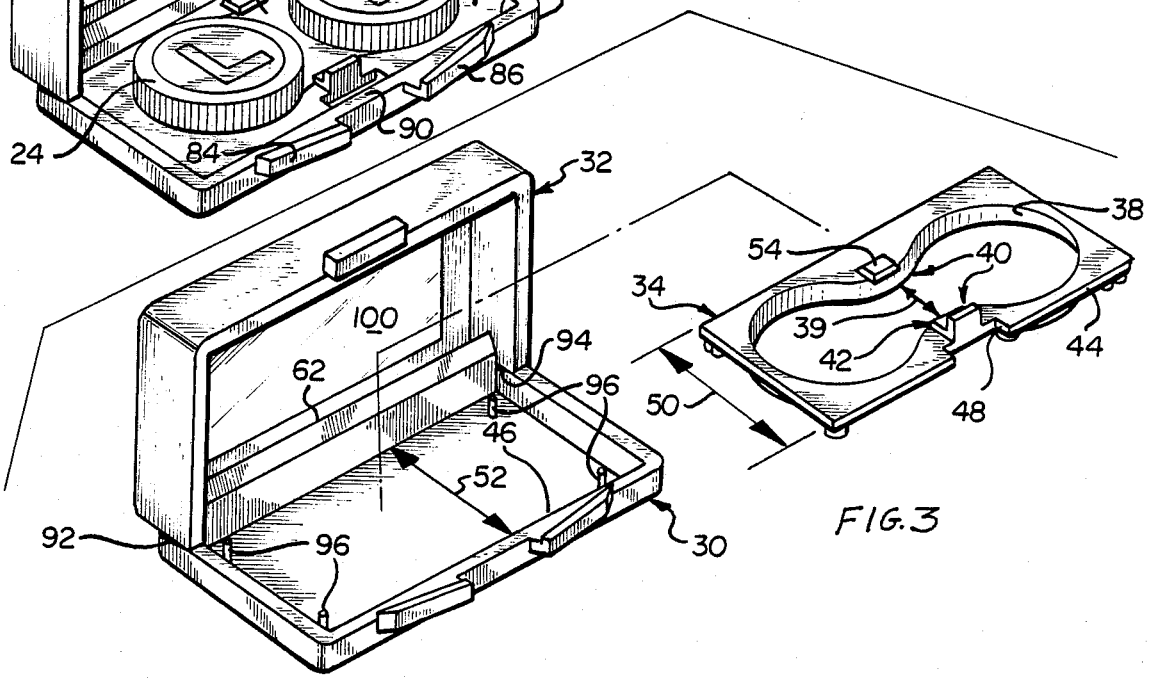
FIG. 3

LENS CASE

BACKGROUND OF THE INVENTION

This invention is directed generally to lens cases of the type provided for contact lenses, and more particularly to a novel carrying case for carrying a separate lens case which may be removed therefrom and placed in another apparatus for periodic cleaning or disinfecting of the lenses.

In order to prevent or reduce the possibility of eye infection, soft contact lenses must be periodically subjected to a disinfecting procedure. In order to accomplish this, the lenses are heated to a predetermined temperature in a disinfecting unit for some specified length of time to assure the desired disinfecting action. Many disinfector units are designed to heat the lenses, while the latter are disposed in a container or lens case, often within a quantity of saline solution. Accordingly, such heating units are often configured with one or more wells or receptacles to receive the contact lenses or, alternatively, to receive lens cases within which the lenses are disposed.

The present invention provides a novel and improved carrying case which is advantageously configured to receive and carry a contact lens case and to permit removal thereof for insertion in a heating or disinfecting device. That is, the present invention advantageously permits the carrying of contact lenses in one and the same lens case which is placed in the heating or disinfecting apparatus to achieve disinfecting of the lenses Hence, the lenses may be conveniently carried about following the cleaning or disinfecting operation, without opening the lens case or otherwise disturbing the lenses, thus advantageously retaining the lenses in the desired disinfected condition prior to application thereof to the eye of the the wearer.

Since the carrying case of the invention permits direct transference of the lens case thereto upon completion of the disinfecting operation, no further possibly contaminating handling of the lenses need occur. Moreover, the carrying case of the invention provides protective covering to the lens case to assure against possible partial opening and contamination of the same, might otherwise occur with the lens case itself being jostled about in a purse or pocket or the like prior to removal of the lenses therefrom for use by the wearer.

Further, the present invention permits the fabrication or manufacture of a carrying case with a releasable latch from only three parts. That is, the case is assembled utilizing only a base member, a cover member and an insert member.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures in which like reference numerals identify like elements, and in which:

FIG. 1 is an exploded perspective view illustrating a carrying case in accordance with the invention, in connection with a separate lens case and related disinfecting or heating apparatus;

FIG. 2 is a perspective view of a carrying case in accordance with the invention with a lens case inserted therein in accordance with the invention;

FIG. 3 is an exploded perspective view similar to FIGS. 1 and 2 further illustrating assembly of a novel insert member with respective hingedly joined base and cover members of the carrying case of the invention;

DETAILED DESCRIPTION OF THE ILLUSTRATED EMBODIMENT

Figure 4:
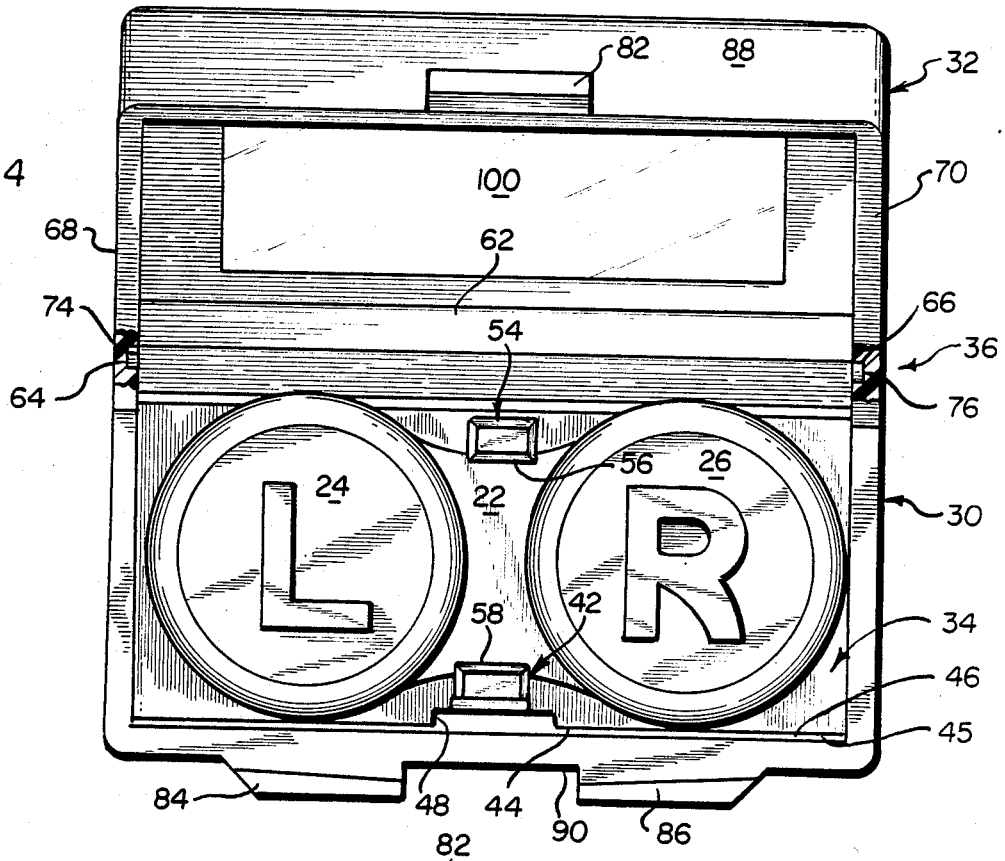
FIG. 4 is an enlarged top plan view, partially broken away and in section, illustrating the carrying case of the invention with a lens case therewithin.
Figure 5:
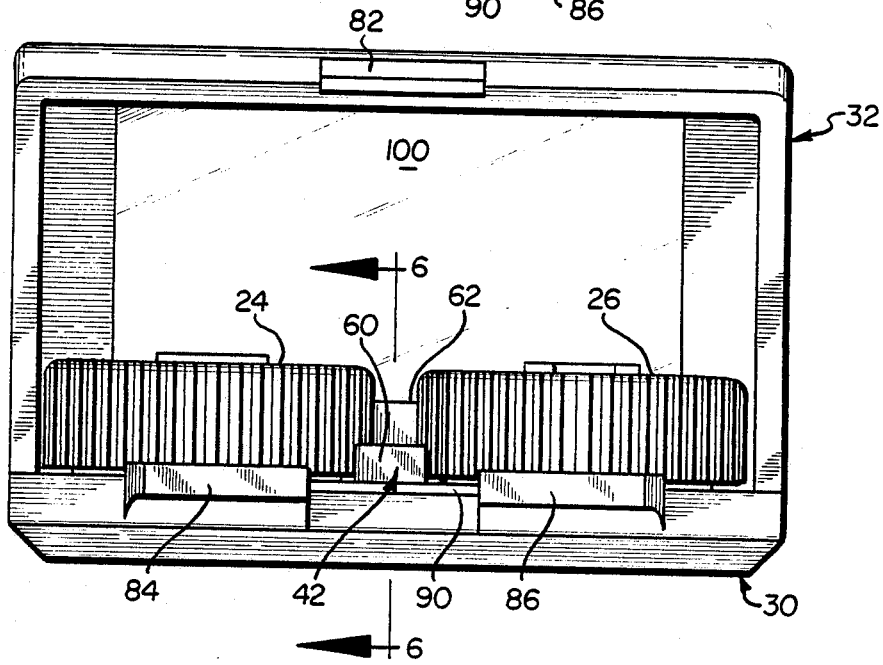
FIG. 5 is an enlarged front elevation of the carrying case with inserted lens case of FIGS. 2 and 4.

Referring now to the drawings and initially to FIG. 1, a carrying case in accordance with the invention is designated generally by the reference numeral 10. The carrying case 10 is advantageously configured for removably holding a contact lens case designated generally by reference numeral 12. This contact lens case is removable from the carrying case 10 for placement in a heating or disinfecting apparatus designated generally by reference numeral 14.

In this latter regard, it will be seen that the contact lens case 12 has a given peripheral configuration defined by peripheral edge portion 16 thereof In the illustrated embodiment, this peripheral edge is generally figure eight-shaped (or peanut-shaped). The lens case 12 generally includes a pair of similar lens compartments, 18, 20 of generally similar cylindrical external peripheral configurations of a given diameter These two lens compartments 18 and 20 are joined by an integrally formed web portion 22 which is of generally lesser transverse dimension than the diameters of the respective compartments 18, 20 to thereby define the generally figure eight-like (or peanut-shaped) peripheral configuration of edge 16. The lens compartments are also provided with respective removable cap members 24 and 26, which may be threadably or otherwise engageable and disengageable with respect to the compartments 18 and 20.

Accordingly, the heating or disinfecting device or apparatus 14, which is somewhat diagrammatically illustrated herein, is provided with an irregularly shaped receiving well or recess 25 which is shaped to generally conform to the peripheral edge portion 16 of the lens case 12. This recess or well 25 is of sufficient depth to receive a substantial portion of the case 12 therewithin, preferably with the web portion 22 substantially flush with a top surface 28 of the disinfecting apparatus 14 surrounding the well or recess 25.

Turning now again to the carrying case 10 of the invention, and referring also to the remaining drawings, the carrying case will be seen to comprise three elements, namely a base member 30, a cover member 32, and an insert member 34. Generally speaking, the cover member and base member have a predetermined, similar peripheral configuration. Moreover, a hinge arrangement or hinge means designated generally by reference numeral 36 (see FIGS. 4 and 6), joins the cover member to the base member generally along respective facing edges thereof so as to define respective open and closed conditions of the carrying case. In this regard, the similarly configured peripheries of the cover and base members are brought into substantially aligned and abutting condition when the case 10 is in the closed condition. On the other hand, the open condition of the case 10 is illustrated in each of FIGS. 1–6 of the drawings In accordance with the invention, the insert member 34 comprises a frame-like member mounted to and within the base member 30 so as to define a recess 38 in the base member of complementary configuration for receiving the contact lens case 12 therewithin. Moreover, additional releasable latching means 40 are formed on the frame-like member for releasably engaging the contact lens case 12 so as to releasably hold the same received in the recess 38 defined by the insert member 34 and base 30.

Figure 6:
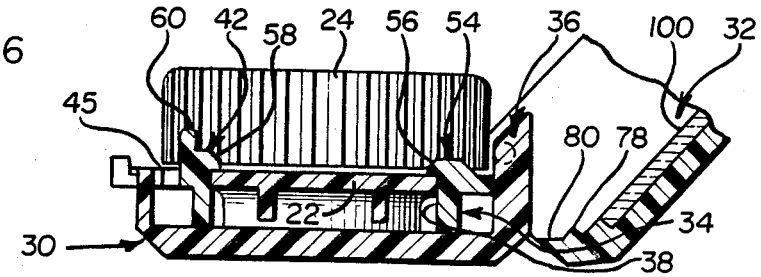
FIG. 6 is a partial sectional view taken generally in the plane of the line 6—6 of FIG. 5.

More particularly, in the illustrated embodiment the recess 38 defined by the frame-like insert member 34 in the base member 30 is generally figure-eight or peanut-shaped, and thus similar in form to the recess or well 26 of the heating or disinfecting unit 14 described above. Advantageously then, this peanut-shaped or figure-eight-shaped recess 38 is of complementary form for receiving the contact lens case, and particularly the similar figure-eight or peanut-shaped peripheral edge 16 thereof described above The releasable latching means comprises tab means 42 formed on the frame-like member and configured and located thereon for overlying an edge part of the lens case 12. In the illustrated embodiment, the tab 42 is located along a reduced transverse dimension central portion 39 of recess 38 which receives the web 22. Moreover, the upper surface of the frame member 34 as well as the upper surface of web 22 of contact lens case 12 are both substantially flat, and the recess 38 is of sufficient depth so as to receive the flat surface of the web portion substantially flush with the flat upper surface of the frame-like member 34, as best seen in FIGS. 2 and 6. Accordingly, the tab 42 is located so as to generally overlie an edge part of the upper flat surface of web portion 22.

In the illustrated embodiment, the base member and cover member are generally rectilinear in form or configuration. In particular, the base member has a substantially rectilinear interior, while the frame-like member 34 defines a similar generally rectilinear outer periphery for interfitting within the interior of the base member. However, a transverse dimension of the frame-like member 34, indicated in FIG. 3 by reference numeral 50 is somewhat less than a like transverse dimension of the interior of the base member, indicated in FIG. 3 by reference numeral 52. This defines the relief area or region, or a space or gap 45 as previously described therebetween when the frame is assembled with the base, as shown in FIGS. 1, 2 and 4–6.

In accordance with a further feature of the invention, the frame 34 and base member 30 define therebetween a relief area 45, generally taking the form of a slight space or gap between a forward edge 44 of the insert member 34 and a facing inner wall surface 46 of the base member 30. The relief area 45 thus defined permits sufficient flexible bending or drawing back of the edge 44 of the frame member to generally release the tab-like member 42 from its overlying condition relative to web 22. In the illustrated embodiment, an additional relief area is also provided in the form of a cutout area or notch 48 in the edge surface 44 which extends somewhat to either side of, as well as across, the area therein at which the tab 42 is located. The relief provided by notch 48 is preferably sufficient to enable the frame 34 to flex in the area of the tab 42 to permit removal of the case 12. The additional relief at area 45 further facilitates flexing of the tab 42.

In operation the relief areas 45 and 48 define an area for permitting resilient deformation of edge portion 44 of the frame-like member sufficient to permit movement of the tab 42 away from its overlying condition relative to web 22, so as to allow insertion and removal of the lens case 12 relative to the recess 38.

With the embodiment shown, the base member and cover member are generally rectilinear in form or configuration In particular, the base member has a substantially rectilinear interior, while the frame-like member 34 defines a similar generally rectilinear outer periphery for interfitting within the interior of the base member. However, a transverse dimension of the frame-like member 34, indicated in FIG. 3 by reference numeral 50 is somewhat less than a like transverse dimension of the interior of the base member, indicated in FIG. 3 by reference numeral 52. This defines the relief area or region, or a space or gap 45 as previously described, therebetween when the frame is assembled with the base, as shown in FIGS. 1, 2 and 4–6.

The tab means 40 as illustrated includes a second, similar tab-like member 54, disposed generally transversely opposite the first tab member 42 on the insert member 34 This second tab 54 also extends inwardly of the opening 38 to overlie a transversely opposed edge of the web portion 22 of the case 12 In the preferred form of the invention illustrated, each of the tabs 42, 54 includes a generally inwardly and downwardly beveled portion 56, 58 (see FIG. 4) relative to the opening 38 so as to form a lead-in surface for guiding the peripheral edge 16, and particularly web 22, into engagement with the recess 38. The tab 42 additionally has an upwardly projecting gripping surface portion 60 to facilitate or accommodate gripping thereof for release of the tab relative to the web portion 22, that is by physically deforming the material of the frame 34 adjacent the tab 42 into the relief area or region provided by the gap 45.

In the illustrated embodiment, the hinge means joining the cover and base members, as best viewed in FIG. 4, comprises an upstanding rear wall segment 62 of the base member which supports a pair of oppositely outwardly projecting and coaxially aligned pin-like projections 64 and 66 A pair of parallel and spaced depending sidewalls 68 and 70 of the cover 32 define respective complementary bores 74, 76 which are configured and aligned for rotatably receiving the pin-like projections 64 and 66

Preferably, the cover member has a downwardly depending rear wall portion or segment 78, of sufficient extent to provide, together with the base rear wall 62, a rear closure of similar extent to the cover sidewalls 68 and 70. The cover rear wall 78 additionally preferably has a beveled edge surface 80 to avoid interference thereof with the base member rear wall 62 during hinged movement therebetween, as best viewed in FIG. 6.

The cover member and base member are also provided with respective complementary portions 82 and 84, 86 of a purse latch to effect releasable locking closure therebetween. The purse latch portions are configured and located for elastic deformation to permit the opening and closing thereof In particular, the purse latch portions 84, 86 of the base member make use of the above-described relief area 45 to permit sufficient elastic deformation thereof to accommodate opening and closing of the purse latch The purse latch portion 82 on the cover is formed at the lowermost portion of a downwardly depending front wall 88 thereof This wall 88 is sufficiently flexible to permit sufficient movement of latch portion 82 to facilitate locking and releasing thereof relative to latch portions 84 and 86 and a cooperating intermediate locking lip portion 90 formed therebetween on the base member 30.

Preferably, the base member 30, as best viewed in FIG. 3, is additionally provided with recessed or beveled sidewall corner portions 92, 94 flanking the rear wall portion 62 to accommodate or provide clearance for facing rear corner portions of the cover member sidewalls during opening and closing.

In the preferred embodiment illustrated, the insert member 34 is positioned and held in place relative to the base 30 by a plurality of upstanding pins 96, preferably formed in the latter A plurality of complementary bores or apertures (not shown) are formed adjacent respective corners of the frame 34 for engagement with pins 96 which are likewise located adjacent corners of the base 30. Preferably, the two are joined in a press fit, although other methods such as adhesives, sonic welding, or other means or processes may be used to accomplish the desired joining of the insert with the base.

Preferably the recess 38, as best viewed in FIG. 6, is formed or defined by downwardly depending interior wall surfaces of the insert member 34. The height or depth of these wall surfaces is such as to define the desired effective depth of recess 38. That is, as best viewed in FIG. 6, recess 38 and the walls defining the same are arranged to generally bottom out in the base 30 so as to define the effective depth of the recess 38 This depth is such as to receive the lens case 12 with the top of the web 22 substantially flush with the top surface of insert 34, as previously mentioned A mirror 100 may be provided on an interior surface of the cover member 32 to assist the wearer in inserting and removing contact lenses While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A carrying case for contact lens case having a predetermined external peripheral configuration, said carrying case comprising: a base member defining a predetermined peripheral configuration and having a predetermined depth; a cover member defining a predetermined peripheral configuration similar to that of the base member; hinge means joining said cover member to said base member generally along respective facing edges thereof so as to define an open condition and a closed condition of the carrying case, said similarly configured peripheries being substantially abutting and aligned in the closed condition; and an insert member mounted within said base member; said insert member comprising a frame-like member having a flat surface raised above a bottom surface of said base member and a through opening in said flat surface for forming a recess in said base member, and said frame having an internal peripheral surface surrounding said opening of complementary internal peripheral configuration with said predetermined external peripheral configuration of said lens case for surroundingly engaging and receiving said contact lens case within the recess formed by the frame member in the base, and latching means on said insert member for engaging said contact lens case for releasably holding the same received in said recess.

2. A carrying case according to claim 1, wherein said latching means comprises tab means formed on said frame-like member and configured and located thereon for overlying a predetermined edge part of said lens case, and means defining a relief area in said base member for permitting resilient deformation of a portion of said frame-like member sufficient to permit movement of said tab means away from said overlying condition for allowing insertion and removal of said lens case relative to said recess.

3. A carrying case according to claim 2 wherein said predetermined peripheral configuration of said contact lens case defines a pair of similar lens compartments of generally cylindrical external peripheral configuration of a given diameter, and a web portion of lesser transverse dimension than said given diameter joining said generally cylindrical lens compartments, and wherein said frame-like member defines a through opening of similar configuration to the cylindrical lens compartment exterior surface portions and the web portion for receiving the same, said tab means being configured and located on said frame-like member for overlying an edge part of said web portion.

4. A carrying case according to claim 3 wherein said web portion is substantially flat, and wherein an upper surface of said frame-like member is substantially flat, said frame member together with said base member defining a recess of sufficient depth to receive said lens case with said flat surface of said web portion substantially flush with the flat upper surface of the frame-like member.

5. A carrying case according to claim 3 wherein said base member has a substantially rectilinear interior and said frame-like member defines a substantially similar generally rectilinear outer periphery for interfitting therewithin, a transverse dimension of said frame-like member at least in the region thereof adjacent said web portion of said lens case being less than the transverse dimension across the interior of said base member to thereby define said relief region for permitting deformation of the frame for withdrawal of said tab means to a sufficient extent to permit removal of the contact lens case.

6. A carrying case according to claim 1 wherein said hinge means comprises an upstanding rear wall segment across said base member having oppositely outwardly projecting and coaxially aligned pin-like projections, and a pair of parallel and spaced depending sidewalls on said cover member having bores configured and aligned for rotatably receiving said pin-like projections.

7. A carrying case according to claim 6 wherein said cover member further includes a downwardly depending rear wall of sufficient extent to provide, together with said base rear wall, a rear closure of similar extent to said cover sidewalls, said cover rear wall having a beveled edge surface to prevent interference thereof with said base member rear wall during hinged movement therebetween.

8. A carrying case according to claim 2 wherein said cover member and said base member are further provided with respective complementary portions of a purse latch to achieve releasably locking closure thereof, said purse latch portions being configured and located for elastic deformation to permit opening and closing thereof, utilizing the same relief region to accommodate said deformation as the relief region utilized by said frame-like member latching means.

9. A carrying case according to claim 6 wherein said base member is further provided with recessed, beveled side wall corner portions flanking said rear wall portion to provide clearance for facing rear corner portions of said cover member sidewalls.

10. A carrying case according to claim 4 wherein said tab means comprises a pair of transversely opposed tabs on said frame extending respectively inwardly of said opening therein to overlie transversely opposed edges of said web portion, said relief region being located for accommodating a portion of said frame member adjacent one of said tabs.

11. A carrying case according to claim 10 wherein said one tab has an upwardly projecting gripping surface portion to facilitate gripping for release thereof relative to said web portion and a beveled surface leading into said recess to facilitate snapping engagement of said web portion thereover.

12. A carrying case for a contact lens case having a predetermined peripheral configuration, said carrying case comprising: a base member defining a predetermined peripheral configuration; a cover member defining a predetermined peripheral configuration similar to that of the base member; hinge means joining said cover member to said base member generally along respective facing edges thereof so as to define an open condition and a closed condition of the carrying case, said similarly configured peripheries being substantially abutting and aligned in the closed condition; and an insert member mounted to said base member; said insert member comprising a frame-like member defining a recess in said base member of complementary configuration for receiving said contact lens case therewithin, and latching means on said insert member for engaging said contact lens case for releasably holding the same received in said recess; wherein said latching means comprises tab means formed on said frame-like member and configured and located thereon for overlying a predetermined edge part of said lens case, and means defining a relief area in said base member for permitting resilient deformation of a portion of said frame-like member sufficient to permit movement of said tab means away from said overlying condition for allowing insertion and removal of said lens case relative to said recess; wherein said predetermined peripheral configuration of said contact lens case defines a pair of similar lens compartments of generally cylindrical external peripheral configuration of a give diameter, and a web portion of lesser transverse dimension than said given diameter joining said cylindrical lens compartments, and wherein said frame-like member defines a through opening of similar configuration to the cylindrical lens compartment exterior surface portion said the web portion for receiving the same, said tab means being configured and located on said frame-like member for overlying an edge part of said web portion.

13. A carrying case according to claim 12 wherein said web portion is substantially flat, and wherein an upper surface of said frame-like member is substantially flat, said frame member together with said member defining a recess of sufficient depth to receive said lens case with said flat surface of said web portion substantially flush with the flat upper surface of the frame-like member.

14. A carrying case according to claim 12 wherein said base member has a substantially rectilinear interior and said frame-like member defines a substantially similar generally rectilinear outer periphery for interfitting therewithin, a transverse dimension of said frame-like member defines a substantially similar generally rectilinear outer periphery for interfitting therewithin, a transverse dimension of said frame-like member at least in the region thereof adjacent said web portion of said lens case being less than the transverse dimension of said frame-like member at least in the region thereof adjacent said web portion of said lens case being less than the transverse dimension across the interior of said base member to thereby define said relief region for permitting deformation of the frame for withdrawal of said tab means to a sufficient extent to permit removal of the contact lens case.

15. A carrying case according to claim 13 wherein said tab means comprises a pair of transversely opposed tabs on said frame extending respectively inwardly of said opening therein to overlie transversely opposed edges of said web portion, said relief region being located for accommodating a portion of said frame member adjacent one of said tabs.

16. A carrying case according to claim 15 wherein said one tab has an upwardly projecting gripping surface portion to facilitate gripping for release thereof relative to said web portion and a beveled surface leading into said recess to facilitate snapping engagement of said web portion hereover.

* * * * *